US008876616B2

(12) United States Patent
Antuna

(10) Patent No.: US 8,876,616 B2
(45) Date of Patent: Nov. 4, 2014

(54) BOXING RING SIMULATOR

(76) Inventor: Louie Antuna, Orlando, FL (US)

( * ) Notice: Subject to any disclaimer, the term of this patent is extended or adjusted under 35 U.S.C. 154(b) by 0 days.

(21) Appl. No.: 13/575,328

(22) PCT Filed: Feb. 12, 2011

(86) PCT No.: PCT/US2011/024664

§ 371 (c)(1),
(2), (4) Date: Jul. 26, 2012

(87) PCT Pub. No.: WO2011/100644

PCT Pub. Date: Aug. 18, 2011

(65) Prior Publication Data

US 2012/0316002 A1 Dec. 13, 2012

Related U.S. Application Data

(60) Provisional application No. 61/304,105, filed on Feb. 12, 2010.

(51) Int. Cl.
*A63C 19/00* (2006.01)
*E04H 17/18* (2006.01)

(52) U.S. Cl.
CPC ..... *A63C 19/005* (2013.01)
USPC ..... 472/93; 256/26

(58) Field of Classification Search
USPC ..... 472/93; 482/12, 83, 93, 148; 256/26
See application file for complete search history.

(56) References Cited

U.S. PATENT DOCUMENTS

| | | | | |
|---|---|---|---|---|
| 2,119,327 | A * | 5/1938 | Gunnarson | 472/93 |
| 3,876,197 | A * | 4/1975 | Jenson | 472/93 |
| 4,091,563 | A * | 5/1978 | Noble et al. | 273/440.1 |
| 5,048,724 | A * | 9/1991 | Thomas | 222/95 |
| 5,611,760 | A * | 3/1997 | Jordan | 482/83 |
| 6,348,028 | B1 * | 2/2002 | Cragg | 482/148 |
| 2002/0091040 | A1 * | 7/2002 | Jackson | 482/12 |

* cited by examiner

*Primary Examiner* — Kien Nguyen

(57) ABSTRACT

A boxing ring simulator/personal boxing ring is portable, lightweight, and interactively responsive to physical contact during use. The boxing ring simulator includes a plurality of springed posts to support horizontal rails that define the ring perimeter and to enable movement of the "ropes". Such components capture the "Stay Off the Ropes" method, thereby providing an opportunity for the user to become familiar with the perimeter inside a ropes/boxing ring. The boxing ring simulator emphasizes keeping all activity in the center of the ring, to train a boxer/user to traditionally remain "off the ropes" while also beneficially allowing the user to learn, practice and experience how to use the ropes and/or to fight off of the ropes.

17 Claims, 8 Drawing Sheets

BOXING RING SIMULATOR

CROSS REFERENCE TO RELATED APPLICATIONS

This application is a continuation of International Application No. PCT/US2011/024664, filed Feb. 12, 2011, which claims the benefit of Provisional Application No. 61/304,105, filed Feb. 12, 2010, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

This non-limiting exemplary embodiment(s) generally relates to a physical training device and, more particularly, to a boxing ring simulator, and methods of assembly thereof.

2. Prior Art

Whether Trainer, Boxer, Striker, Martial Artist, Father, Mother, Son or Daughter, Gym Owner or Fitness Franchise, Fitness and/or Boxing Enthusiast with a need for a defined area, platform, and/or ring, an investment of at least $5000 is typically necessary, wherein known economical boxing rings are usually constructed with metal components, steel, cable or rope for the perimeter and plywood for the floor. The parts, as setup, define the perimeter and platform. The parts are heavy, with a dedicated and large area available for essentially permanent installation. Otherwise, a user is relegated to work on accomplishing typical ring-work outside the ring and without a ring perimeter. Some common training elements, such as footwork rehearsal, may be less effective without full circular motion, in and out and lateral movement, and without practice of foot positioning, pivoting and motion at ring corners. No familiarity can be realized relative to the inside perimeter of the ropes/boxing ring.

Alternative structures have been proposed, but the turnbuckle structure remains essentially constant. That is, a total installation perimeter is required to be greater than the useful ring space, in order to accommodate the turnbuckle structure, thus either limiting ring space or requiring a generally large installation site. Portable boxing rings have been described, for use in smaller spaces and to allow for easier installation; however, presently available portable rings disadvantageously eliminate the turnbuckle function. Without such a function, true ropes training cannot be accomplished.

Therefore, it is readily apparent that there is a need for a boxing ring that is economical, easy to erect and adapted to be transported, that is strong and safe, and that performs according to the necessary functions of a traditional boxing ring, including rope/turnbuckle motion, thereby avoiding the above-discussed disadvantages.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a portable boxing ring, and methods of assembly and use thereof. These and other objects, features, and advantages of the non-limiting exemplary embodiment(s) are provided by a boxing ring simulator/personal boxing ring that is portable, lightweight, and interactively responsive to physical contact during use.

According to its major aspects and broadly stated, in its preferred form, the present boxing ring simulator utilizes a plurality of springed posts to support horizontal rails that define the ring perimeter and to enable movement of the "ropes", capturing the "Stay Off the Ropes" method, providing an opportunity for the user to become familiar with the perimeter inside a ropes/boxing ring, wherein the device was developed with a main emphasis of keeping all activity in the center of the ring, to train a boxer/user to traditionally remain "off the ropes" while also beneficially allowing the user to learn, practice and experience how to use the ropes and/or to fight off of the ropes.

More specifically, the device of the present disclosure in its preferred form is a boxing ring simulator that is essentially formed from portable and lightweight components, such as PVC pipe, for use indoors or outdoors, wherein mechanics preferably near the bottom half of each post enable rope-like movement of the ring simulator device and the lightweight "pipes" simulate the traditional boxing ring ropes feature, which can be three- or four-tier, and with selectable base members that may be weighted, may utilize anchors, or may be attached to a platform. The preferred motion mechanism is a spring member with a flexible rubber boot, wherein the corner posts and side posts are preferably all formed with the motion mechanism, and space is thereby more efficiently used than relative to a traditional ring because no turnbuckle mechanisms are necessary. All footwork may be accomplished inside the entire perimeter, yet ring "walls" are still able to resiliently shift and move, mimicking movement of traditional ropes. The device is easily assembled and disassembled, and is transportable, such as in a canvas duffel bag. Additionally, the device may be erected in any one of a plurality of sizes, depending upon the intended location of use.

Accordingly, a feature and advantage of the present device is its ability to simulate a traditional boxing ring by defining a perimeter and interactively responding to physical contact during use.

Another feature and advantage of the present device is its ability to be easily transported and installed indoors or outdoors in a minimal space.

Yet another feature and advantage of the present device is its ability to be constructed from inexpensive and lightweight, yet sturdy and long lasting components.

Still another feature and advantage of the present device is its ability to assist a user in becoming familiar with the perimeter inside a ropes/boxing ring.

Yet still another feature and advantage of the present device is its ability to train a boxer to traditionally remain "off the ropes," while also beneficially allowing the user to learn, practice and experience how to use the ropes and/or to fight off of the ropes.

Still another feature and advantage of the present device is its ability to facilitate use with essentially any hang bag and/or apparatus positioned in the center thereof.

Still yet another feature and advantage of the present device is its ability to provide for easy assembly and disassembly by as few as one or two persons.

Another feature and advantage of the present device is its ability to be used for training children, youths and adults alike.

Yet another feature and advantage of the present device is its ability to be easily transported to a variety selected locations, such as in a duffel bag.

Still another feature and advantage of the present device is its suitability for compact and conveniently packaged economical shipping.

Still yet another feature and advantage of the present device is its ability to allow an athlete and/or boxer and trainer to accomplish everything traditionally accomplished within the perimeter of the ropes of a traditional boxing ring . . . from mitt work with a trainer, to strict supervised controlled sparring-tactics, shadow boxing, foot work, or general boxing exercises and drills.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
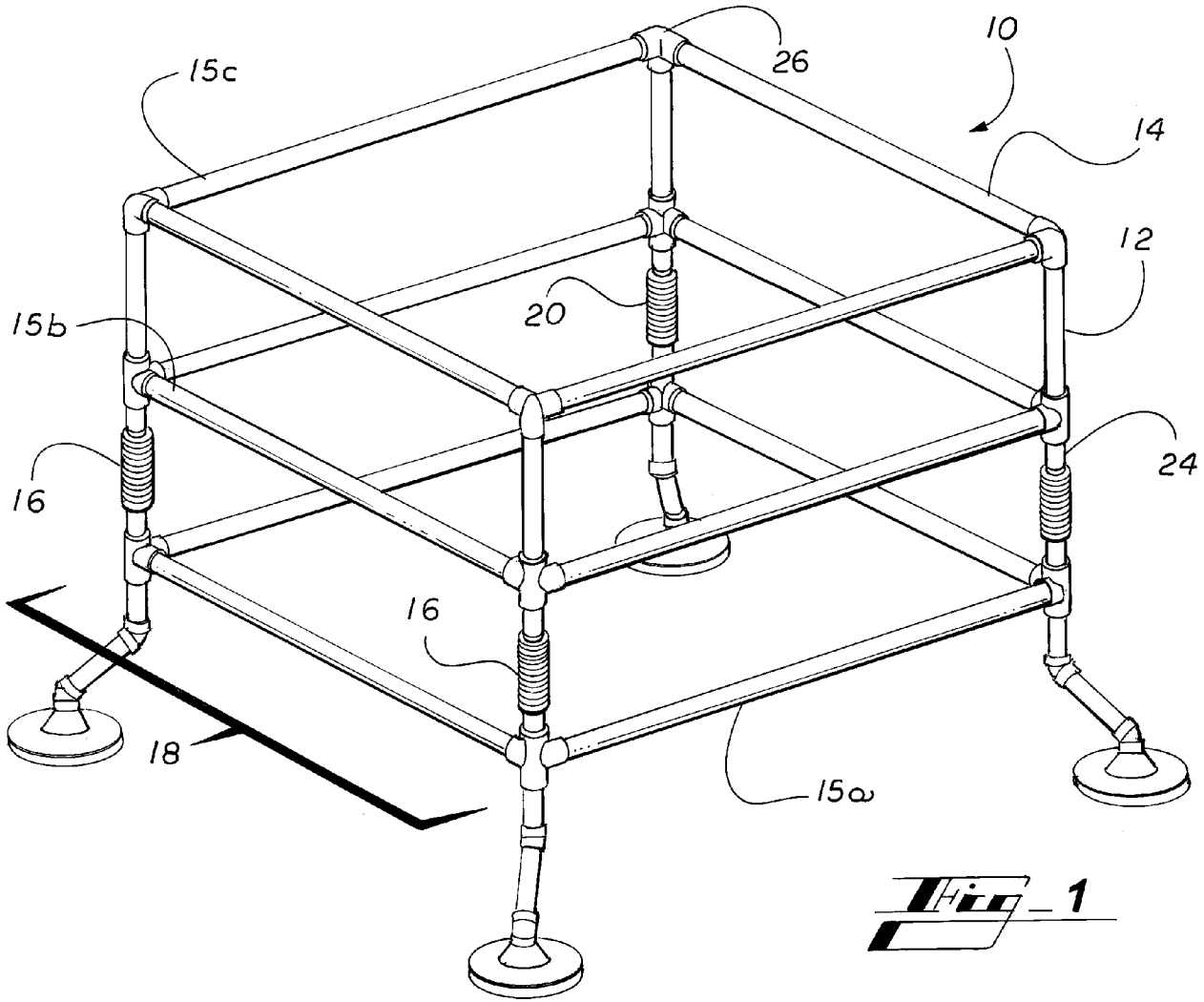
FIG. 1 is a perspective view of a boxing ring simulator, according to a preferred embodiment.
Figures 2A, 2B, 2C:
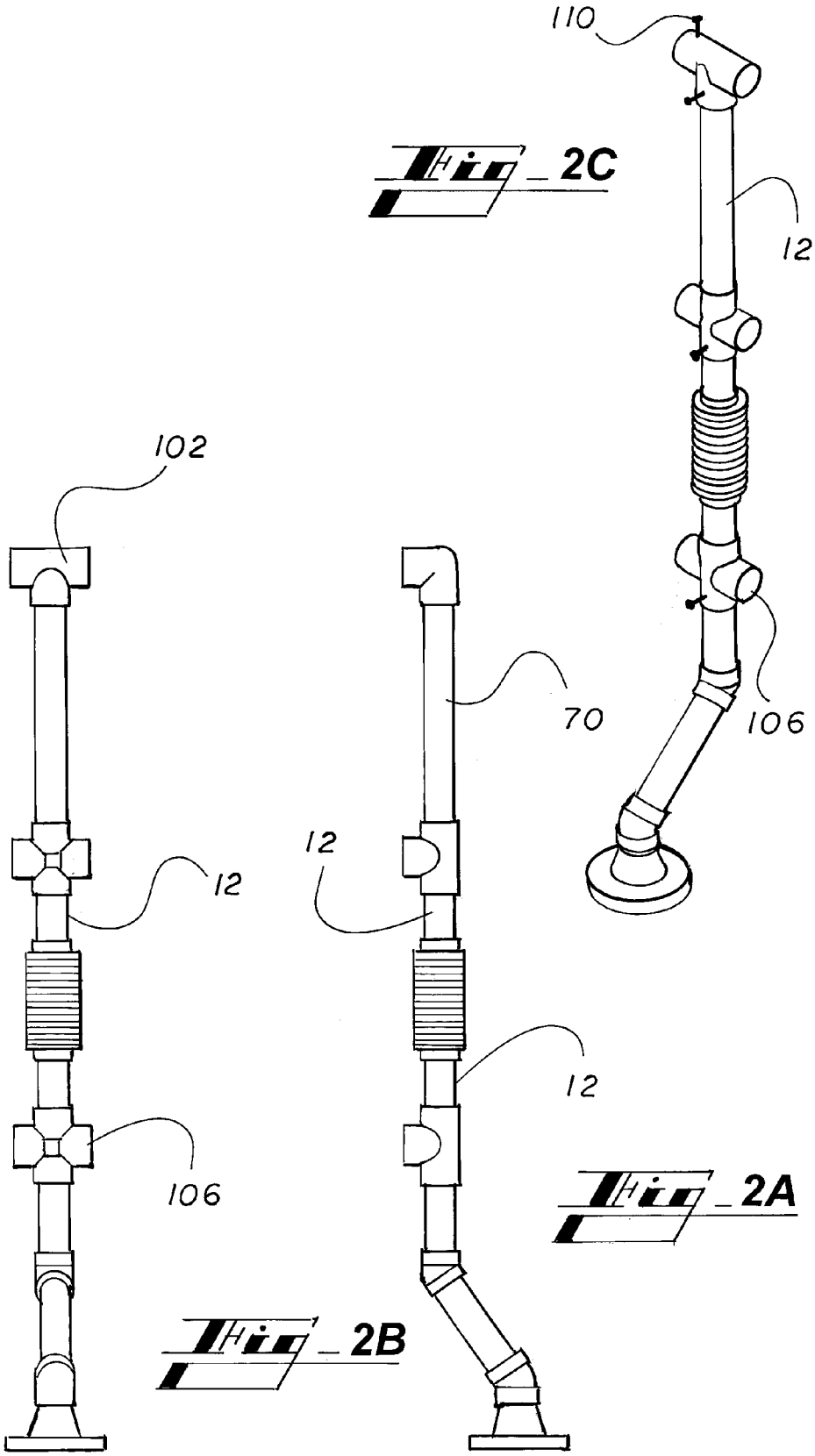
FIG. 2A is a side view of a corner post of the boxing ring simulator of FIG. 1.
FIG. 2B is a front view of a center post of the boxing ring simulator of FIG. 1.
FIG. 2C is a perspective view of a center post of the boxing ring simulator of FIG. 1.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

The non-limiting exemplary embodiment(s) is/are referred to generally in FIGS. 1-9 and is/are intended to provide a boxing ring simulator/personal boxing ring that is portable, lightweight, and interactively responsive to physical contact during use. It should be understood that such non-limiting exemplary embodiment(s) may be used to train many different types of boxers, and should not be limited to any specific boxing skill described herein.

Referring now to FIGS. 1-9, boxing ring simulator 10 is essentially formed from portable and lightweight components, preferably polyvinylchloride (PVC) pipe, or other similarly sturdy and lightweight element capable of performing the necessary functions of boxing ring simulator 10. PVC pipe, for example, allows for utilization of boxing ring simulator 10 indoors or outdoors, given its impervious nature relative to weather. Additionally, PVC pipe supports a plurality of installation methodologies, such as gluing with PVC cement, pinning with stud-fasteners, and/or some combination thereof, either temporary or permanent, as may be desired. Moreover, and without limitation, PVC is smooth in order that posts 12 maybe safe for user contact, wherein it is the mechanics near the bottom half of each post 12 enables rope-like movement of ring simulator device 10, as will be discussed further herein, and as depicted in the figures. The lightweight form is preferred, wherein the lightweight "pipes" represent or simulate the traditional boxing ring ropes feature, replacing and eliminating the need for such heavy ropes. It is noted that the preferred light tubing material is generally more safe, soft and flexible than the traditional ring components of heavy metal or hard wood. Alternate materials could also include, by way of example and not of limitation, aluminum pipe, alloy, extruded tubes, conduit, galvanized metal pipes, copper pipe, and/or steel, or any other material suitable durable yet lightweight, or, alternately, any heavy metal or hardwood, but with some likely diminished benefit relative to weight, portability, and weatherability.

The portable nature of boxing ring simulator 10 enables its installation and use with essentially any hang bag and/or apparatus positioned in the center thereof, simply by placing boxing ring simulator 10 around the desired apparatus. That is, boxing ring simulator 10 provides for easy assembly and disassembly by as few as one or two persons, and can be used for training children, youths and adults alike, in a variety selected locations, with easy transport, such as in canvas duffel bag 100, wherein ring simulator device 10 may be provided in set and expandable set form, packaged for transport in such bag 100. It should be noted that the preferred construction components for boxing ring simulator 10 are particularly suitable for compact and conveniently packaged shipping, further enhancing the cost-effectiveness of ring-simulator device 10. That is, it is particularly noted that the preferred manufacture and construction of ring-simulator device 10 facilitates shipping thereof in a reasonably dimensioned box, thereby allowing for economical delivery to essentially any location.

Figures 9, 11:
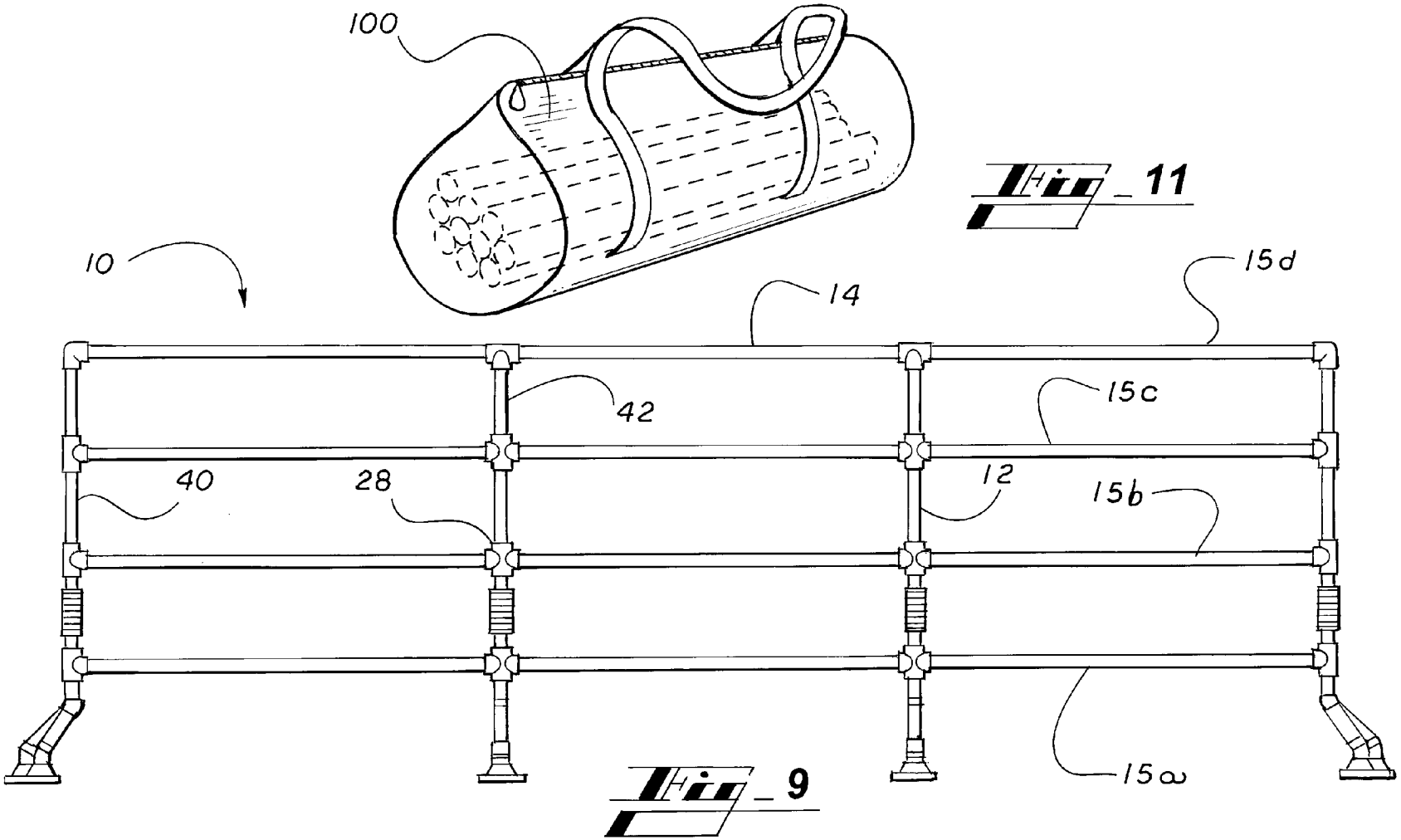
FIG. 9 is a perspective view of a large boxing ring simulator, according to a preferred embodiment.
FIG. 11 is a perspective view of a transport bag, according to an alternate embodiment.

Moreover, the preferred construction components for ring-simulator device 10 facilitate the easy selection of and/or expansion from a three-tier practice-style ring, such as shown in FIG. 1, to a four-tier competition ring, such as shown in FIG. 9. It is noted, however, that the preferred three tier embodiment, as described, allows for greater ease of entry through the "ropes" when compared to the alternate four tier embodiment. That is, the distance between the ropes is reduced in the four-tier competition ring, relative to that of the three-tier practice-style ring, wherein posts 12 accommodate more tiers, closer together, for the four-tier embodiment; hence, stepping through the ropes is more difficult for the four-tier embodiment.

As a cost-effective, functional, freestanding, lightweight, expandable, and portable unit, boxing ring simulator 10 provides for essentially universal access to a boxing ring, whether desired by an individual as an additional piece of fitness equipment for convenient personal and private training, or by a fitness facility previously unwilling to sacrifice valuable space required by traditional rings but enthusiastic about the boxing ring simulator 10 option of easily dismantling, erecting, and relocating as may be convenient or necessary.

Figure 7B:
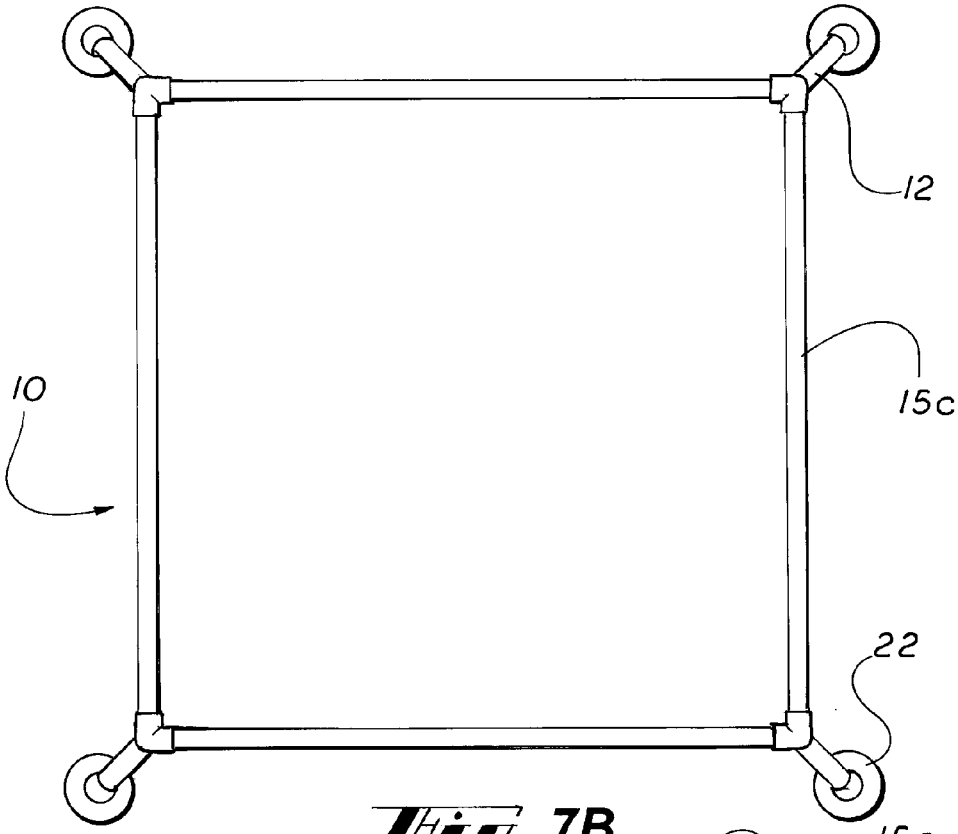
FIG. 7B is an overhead view of the small boxing ring simulator of FIG. 7A.
Figure 7A:
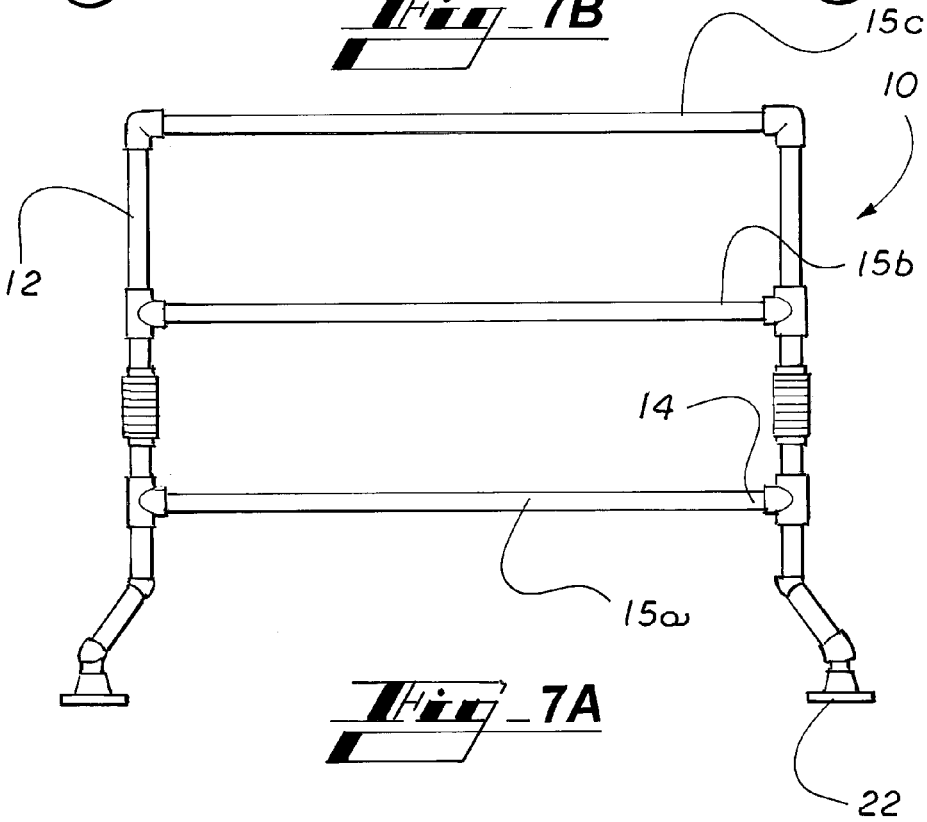
FIG. 7A is a perspective view of a small boxing ring simulator, according to a preferred embodiment.
Figure 8:
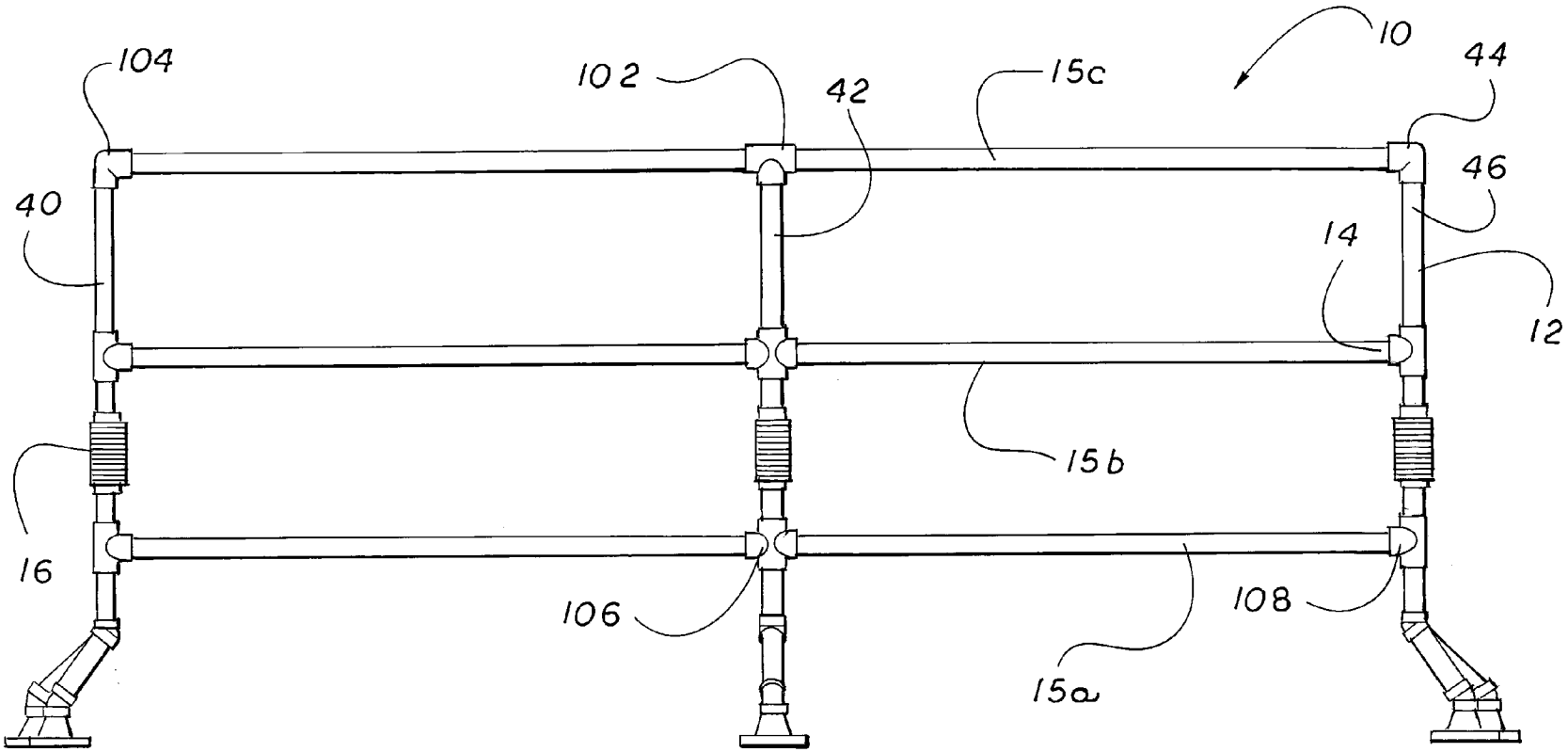
FIG. 8 is side view of a medium boxing ring simulator, according to a preferred embodiment.

The preferred structural configuration of ring simulator device 10 facilitates a realization of up to 20 feet lengths on each inside length of the perimeter of ring simulator device 10, whether assembled with three tiers or four tiers. For example, FIGS. 7A-7B depict a 5'×5' version with three tiers, FIG. 8 depicts a 10'×10' version with three tiers, and FIG. 9 depicts a 20'×20' version with four tiers. Other dimensions may be created, as desired, such as 15'×15' or other dimensions, and according to different selected lengths of components. Irrespective of the perimeter dimensions, either three or four tiers may be selected.

As may be noted in the figures, the preferred embodiment has features in common, wherein three tiers 14 are provided as simulated ropes for a training ring, as representatively shown in FIGS. 1, 7A, 7B, and 8. As noted, in an alternate embodiment, four tiers 14 may be included as simulated ropes for an official ring, as representatively shown in FIG. 9, wherein the perimeter measurements are the same as that of three tiers 14, but the distance between each tier 14, or rope, is smaller for four tiers 14, relative to three tiers 14.

Also, although square versions are preferred, other shapes could be alternately utilized, including, for example, a pentagon or octagon, or any other desired shape, such as for mixed martial arts, or the like. Thus, valuable space need not be sacrificed permanently, wherein the square footage of ring simulator device 10 is not only selectable, but it is expandable according to changing needs and accommodations of the user and/or facility. For example, expansion may preferably be accomplished in 5' or 10' tubing increments, such that a 5' ring may be expanded to a 10' ring, a 10' ring may be expanded to a 20' ring, and/or a 15' ring may be expanded to a 20' ring, such as to better simulate an official training and competition boxing ring, as desired. The expansion could also include the addition of a fourth tier to a three tier ring, in which case each tier 14 is positioned closer together to accommodate four tiers on the same posts. Additionally, it should be readily recognized that tubing increments may be longer or shorter than 5', if desired. Moreover, for mixed martial arts, ring simulator device 10 could include peripheral fencing; for example, plastic vinyl fencing could be fastened to tiers 14.

In the preferred embodiment, such as exemplarily depicted in FIG. 1, first or bottom tier 15*a* is generally solid, motion mechanism 16 is preferably positioned on each post 12 thereabove, and below second or middle tier 15*b*. The third or top tier 15*c* is positioned preferably above second or middle tier 15*b*. As shown in FIG. 9, fourth tier 15*d* may be positioned above third or top tier 15*c*, as preferred, wherein in such an embodiment, the construction of third or top tier 15*c* would duplicate that of second or middle tier 15*b*, and the fourth tier would be formed according to the manner described for the third or top tier 15*c* in a three tier design. As previously noted, although the construction is otherwise the same, the tiers of the four tier embodiment are positioned closer together, with less space in between each tier; thus, bottom tier 15*a* and middle tier 15*b* are closer together for the four tier embodiment than for the three tier embodiment, and so on. Motion mechanism 16 preferably includes boot 30, preferably formed of flexible rubber or the like, for protection and safety relative to both the user and the device 10.

Referencing, for example, FIGS. 8 and 9, plurality of posts 12 includes plurality of corner posts 40 and plurality of center posts 42, wherein assembly and components are generally the same for all plurality of posts 12 except for varied link elements 44 that connect plurality of pipes 46. Each center post 42 utilizes T-connector 102 to assist in definition of the uppermost row, either third tier 15*c* or fourth tier 15*d*. Each corner post 40 utilizes Y-connector 104 to assist in linking the uppermost rows, either third tier 15*c* or fourth tier 15*d*. Similarly, each center post 42 utilizes "+"-shaped connector 106 to assist in definition of the lower rows, bottom tier 15*a* and middle tier 15*b*, and third tier 15*c* if there is a fourth tier 15*d*. Each corner post 40 utilizes right-angle connector 108 to assist in linking the lower rows, bottom tier 15*a* and middle tier 15*b*, and third tier 15*c* if there is a fourth tier 15*d*. According to the preferred embodiment, each corner post 40 and center post 42 have the same base 22.

Figures 3, 4:
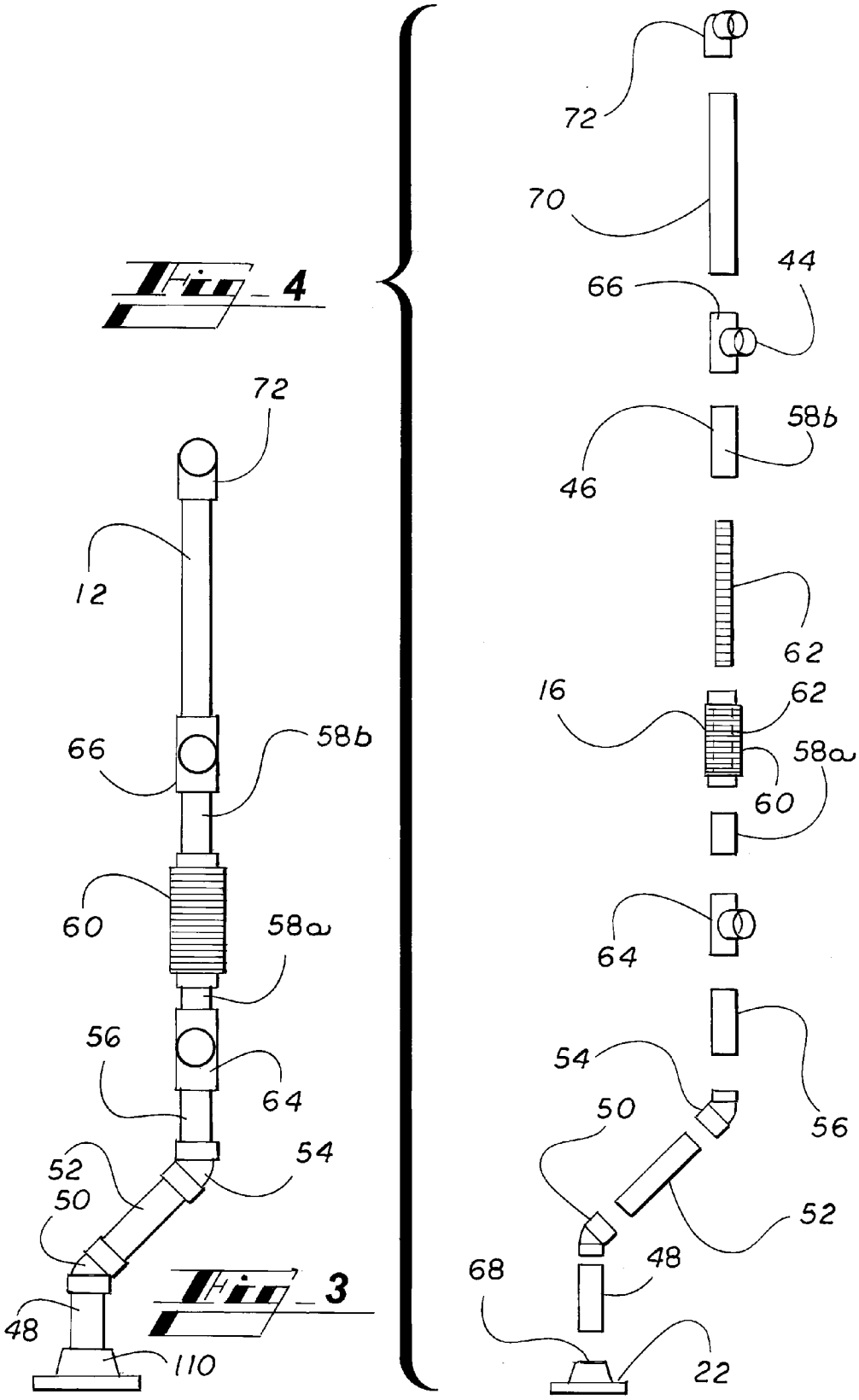
FIG. 3 is a side view of a center post of the boxing ring simulator of FIG. 1.
FIG. 4 is an exploded view of a corner post of the boxing ring simulator of FIG. 1.
Figure 5A:
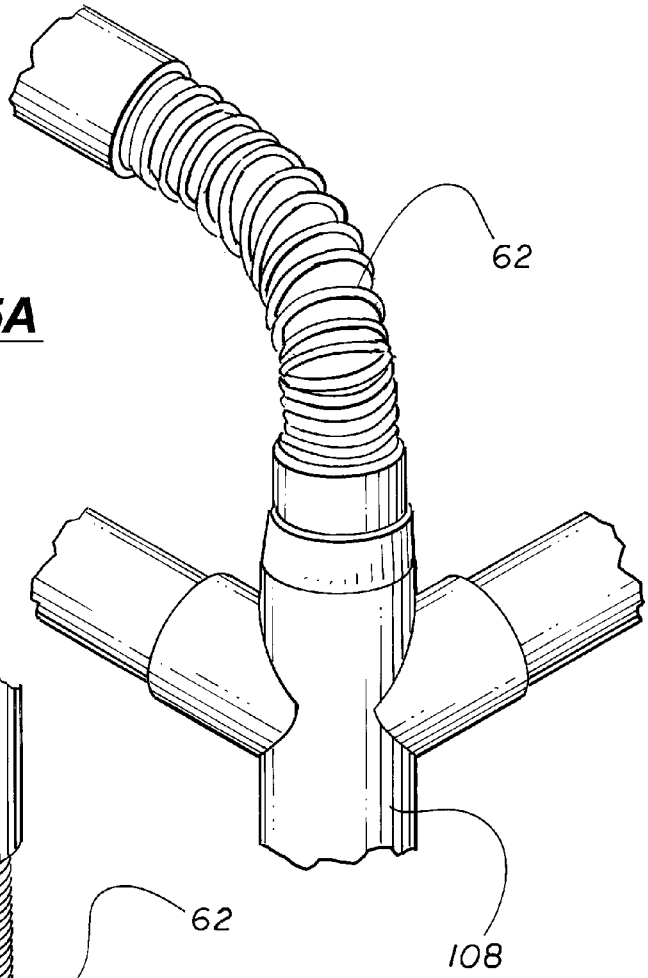
FIG. 5A is a partial perspective view of a post of the boxing ring simulator of FIG. 1, showing a resilient portion in a stressed position, with the boot removed.
Figure 5B:
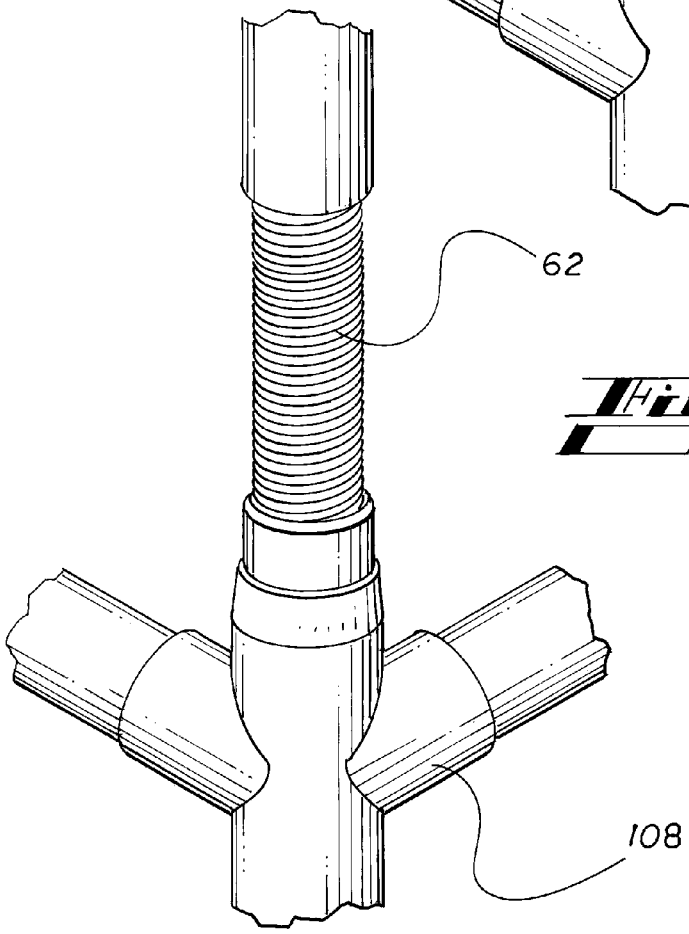
FIG. 5B is a partial perspective view of a post of the boxing ring simulator of FIG. 1, showing a resilient portion in a non-stressed, at rest position, with the boot removed.

Referring now to FIGS. 3 and 4, for assembly of center post 42 (which should be recognized as the same as that for corner post 40, other than the connectors noted hereinabove), bottom center piece 58*a* fits flush into, or alternately onto or over, bottom support ring piece 64, then preferred spring 62 slides into boot 60, wherein top center piece 58*b* fits flush into, or alternately onto or over, upper support ring piece 66. Boot 60 is thus preferably slidably positioned about spring 62. For base 22, flange mount 68 is connected to leg assembly 48, preferably with quick-release pin 110. Elbow 50 connects leg assembly 48 to connector pipe 52, which connects to elbow 54 and leg base pipe 56. Upper support ring piece 66 connects to top tier pipe 70, wherein top tier pipe 70 is capped with 3-way fitting 72. Preferably, adhesive is applied at connections, and/or fasteners, such as plurality of quick-release pins 110. As previously noted, other fasteners could alternately be utilized, such as, for example, screws.

Figure 10:
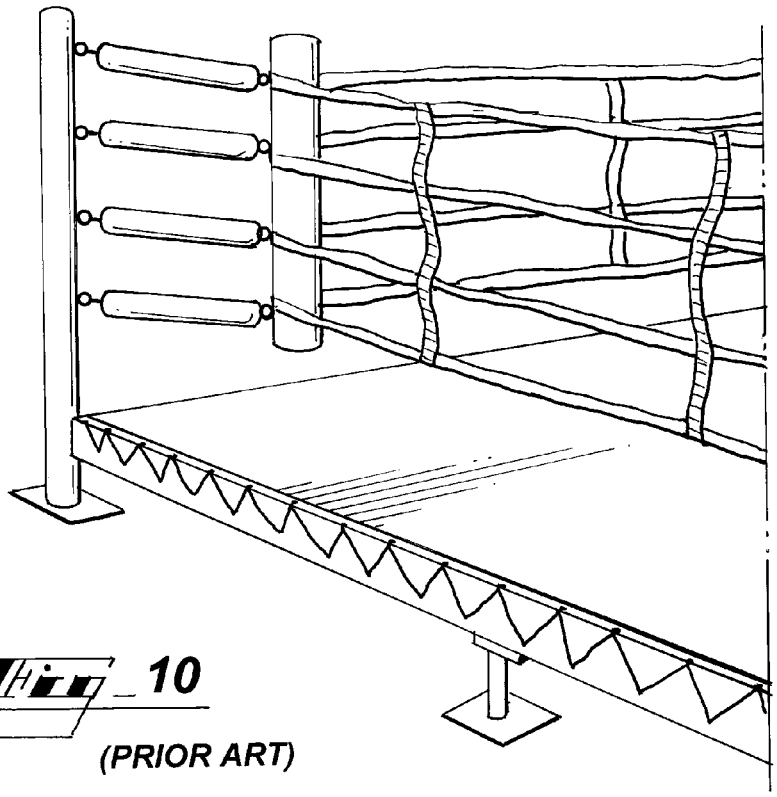
Fig. 10 (PRIOR ART)
FIG. 10 is a partial perspective view of a prior art boxing ring.

Motion mechanism 16 preferably facilitates movement, or shifting, of "walls" 18, as representatively referenced in FIG. 1, relative to the overall structure of ring simulator device 10, wherein resilient member 20 permits movement relative to each post 12. The preferred positioning of motion mechanism 16 proximate first or bottom tier 15*a* enables the realization of flexibility, or resilience, when pressure is applied to second or middle tier 15*b*, third or top tier 15*c*, or, in the case of fourth tier 15*d*, thereupon as well. In this manner and preferred configuration, motion mechanism 16 acts as and/or mimics traditional boxing ropes and the flexion that such ropes provide, yet without necessitating the need for fastening or securing traditional heavy ropes to large steel posts, such as seen in FIG. 10. It should be noted that rather than preferred spring 62, which is a heavy duty coil spring, other means of providing flexion could be utilized, such as bungee, flexible rubber, robotic arm, hydraulic motorized connection, pneumatics, pendulum mechanical link, linear sliding element with recoil spring, or could be another type of spring, such as, for example, compression, extension, die, torsion, tapered, disc, urethane, H-clip and/or custom configuration or element that would function accordingly. It is recognized that structural alternation of device 10 would likely be required for adaptation of an alternate flexion, wherein the preferred performance thereof relative to the "mimic" of traditional ring movement would be diminished as it is based upon the physics of the presently described preferred design.

Base 22 of each post 12 is preferably positioned in a non-axial relationship relative to upright 24 thereof. It is noted that the preferred configuration of ring simulator device 10 receives and/or derives its support essentially directly from vertically placed, or downward supports, to the floor, rather than from horizontally placed supports, wherein a traditionally constructed boxing ring receives and/or derives its support indirectly, from horizontal fastening and/or extension to a post, as shown in FIG. 10. Ring simulator device 10 facilitates realization of the benefits of a traditional boxing ring, and more, with a simpler and more efficient design. Moreover, in such a configuration with base 22 in a non-axial relationship to upright 24, disadvantageous interference to a user from base 22, such as with footwork, is eliminated, again without need for the more complex construction depicted in prior art FIG. 10.

Figure 6:
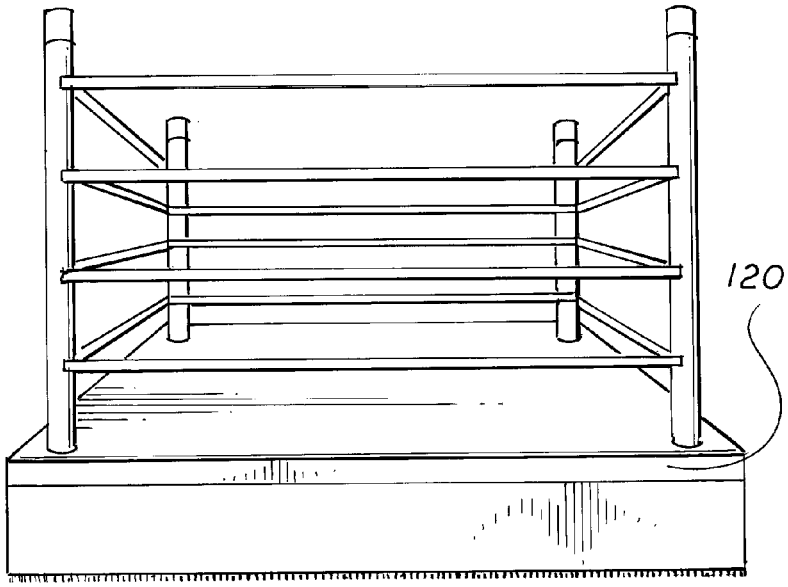
FIG. 6 is a perspective view of a boxing ring simulator, according to an alternate embodiment.

Ring simulator device 10 advantageously allows for economical utilization of floor space and avoidance of complicated turnbuckle construction, yet while allowing simulated movement thereof for effective training, via motion mechanism 16, wherein each post 12 is essentially a solid yet flexible unit. That is, the preferred angle of base 22 relative to each post 12 provides full clearance below first or bottom tier 15*a*, thereby allowing complete footwork movement throughout the entire insider perimeter of ring simulator device 10. It is recognized that for alternate utilization, such as for some mixed martial arts, base 22 could be axially related to upright 24 of each post, such as shown in FIG. 6. However, it is the preferred motion mechanism 16 that facilitates the accomplishment of various fitness exercises within ring simulator device 10.

Depending upon the overall dimensional space desired, or the space available, a particular size version may be utilized, wherein a smaller version may be constructed with posts 12 positioned at corners 26 only, such as in FIGS. 1, 7A, and 7B, and wherein a larger version may be constructed with posts 12 positioned at corners 26 and mid-positions 28, such as in FIGS. 8 and 9. Each base 22 is preferably weighted, or may be positioned via fasteners, such as threaded bolts or the like, or may be otherwise held, such as via suction elements, double-sided adhesive tape, hook and loop fastener, or the like. In such manner, ring simulator device 10 may be utilized as a freestanding unit, wherein any suitable manner of limiting movement of base 22 following installation may be utilized, such as, for exemplary purposes only, each base 22 could be hollow and suitable for filling with a weighted substance, such as sand and/or water. Such a configuration would allow for removal of the weighted substance for subsequent repositioning or movement of ring simulator device 10, wherein selection may be determine according to the support surface, e.g. carpet, hard floor, grass, or other surface. For example, insert anchors could be provided for positioning in lawns or sand, and screw inversion for platforms or hard floors. Thus, alternately, each base 22 could be secured to platform 120, such as a recommended ¾" plywood platform, to flooring, or to another suitable support member, as may be desired. That is, although such more permanent installation is averse to the preferred portability of use for ring simulator device 10, it is recognized that if desired by a user, such installation could be accomplished. Additionally, ring simulator device 10 could be utilized and/or offered in a kit including an appropriately sized roll-away rubber mat.

In use, ring simulator device 10 essentially allows for an athlete and/or boxer and trainer, to accomplish everything traditionally accomplished within the perimeter of the ropes of a traditional boxing ring . . . from mitt work with a trainer, to strict supervised controlled sparring-tactics, shadow boxing, foot work, or general boxing exercises and drills. For example, during footwork rehearsal, as noted, ring simulator device 10 allows for full circular motion, in and out and lateral movement, and including foot positioning, pivoting and motion at corners 26, wherein each corner 26 is free of any impacting base 22. That is, ring simulator device 10 allows the performance of continuous pivoting and footwork to "create angles" while shadow boxing, doing mitt work with a trainer, and during supervised sparring or the like. Jumping rope is also an option, along with use around any boxing apparatus, such as a heavy bag, reflex/slip ball, wrecking/upper cut bag, or the like, as noted.

As noted, the training philosophy of ring simulator device 10 captures the "Stay Off the Ropes" method and provides an opportunity for the user to become familiar with the perimeter inside a ropes/boxing ring, wherein ring simulator device 10 was developed with a main emphasis of keeping all activity in the center of the ring, to train a boxer/user to traditionally remain "off the ropes"; however, ring simulator device 10 also beneficially allows the user to learn, practice and experience how to use the ropes and/or to fight off of the ropes. Thus, ring simulator device 10 increases the benefits of many training regimens, allowing them to occur within a "simulated" boxing ring and its environment.

Ring simulator device 10 is ideal for set up in essentially any garage, backyard, lawn, sandbox, basement, or even poolside or on the beach. It can be used at any Studio/Gym or Fitness Franchise, allowing for simulated ring practice while not tying up the facilities actual/main Boxing Ring, and without interruption of sparring sessions therein, or requiring reservations for sparring. In addition, ring simulator device 10 can be set up in any Aerobics Room, indoor or outdoor playground, basketball court, recreation/community room, or the like. The preferred structural design allows for ring simulator device 10 to be easily transported and set up essentially anywhere, and even shipped to any contingency or military installation for use, both leisure and training, to serve as a boxing ring display at any venue, or even in a conference room for a corporate event. The preferred freestanding ability of ring simulator device 10 therefore allows for temporary or permanent set up in a selected location, dedicated or otherwise, since it can be dismantled at any time. Moreover, it's convenient, light weight, yet strong and durable construction allows for use in any weather.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A boxing ring simulator, comprising:

a plurality of posts, wherein an upper portion of each said post has a first center axis, and wherein a base portion of each said post has a second center axis, and wherein said first center axis and said second center axis are different;

a plurality of tiers, each said tier further comprising at least one elongate member extending between a first and a second of said plurality of posts; and a plurality of connectors, each said connector linking one post of said plurality of posts to one tier of said plurality of tiers;

wherein each said post of said plurality of posts further comprises a flexion element proximate a lower half of said post;

wherein said flexion element further comprises a spring member coaxially related with said first center axis of said post.

2. The boxing ring simulator of claim 1, further comprising a flexible rubber boot, wherein said spring member is essentially surrounded by said flexible rubber boot.

3. The boxing ring of claim 1, wherein said plurality of posts, said plurality of tiers, and said plurality of connectors are formed from generally tubular members.

4. The boxing ring of claim 1, wherein plurality of posts, said plurality of tiers, and said plurality of connectors are at least partially secured relative to one another with adhesive.

5. The boxing ring of claim 1, wherein plurality of posts, said plurality of tiers, and said plurality of connectors are at least partially secured relative to one another with fasteners.

6. The boxing ring of claim 1, wherein said plurality of posts, said plurality of tiers, and said plurality of connectors are at least partially formed from a material selected from the group consisting of aluminum, alloy, extruded tubes, conduit, galvanized metal pipes, copper pipe, steel, heavy metal, and hardwood.

7. The boxing ring of claim 1, wherein said plurality of posts further comprises four corner posts and at least four center posts.

8. The boxing ring of claim 7, wherein said plurality of tiers further comprises a top tier and a plurality of lower tiers;

wherein said plurality of connectors further comprises at least four T-connectors and four Y-connectors;

wherein each said center post further comprises one said T-connector, each said T-connector linking said respective center post to said top tier; and wherein each said corner post further comprises one said Y-connector, each said Y-connector linking said respective corner post to said top tier.

9. The boxing ring of claim 8, wherein said plurality of connectors further comprises at least eight "+"-shaped connectors and at least eight right-angle connectors;

wherein each said center post further comprises at least two "+"-shaped connectors, each said "+"-shaped connector linking said respective center post to one of said plurality of lower tiers; and wherein each said corner post further comprises at least two right-angle connectors, each said right-angle connector linking said respective corner post to one of said plurality of lower tiers.

10. The boxing ring simulator of claim 1, wherein each said post of said plurality of posts further comprises a plurality of tubular members, at least three of said plurality of connectors, a plurality of elbow members, said flexion element, and said base portion.

11. The boxing ring simulator of claim 10, wherein each said post of said plurality of posts is assembled with a first said connector at a proximal end of said post, a first said tubular member engaged with a distal end of said first connector, a second said connector engaged at a distal end of said first tubular member, a second said tubular member engaged with a distal end of said second connector, said flexion element engaged at a distal end of said second tubular member, a third said tubular member engaged at a distal end of said flexion element, a third said connector engaged at a distal end of said third tubular member, a fourth said tubular member engaged at a distal end of said third connector, a first said elbow member engaged at a distal end of said fourth tubular member, a fifth said tubular member engaged at a distal end of said first elbow member, a second said elbow member engaged at a distal end of said fifth tubular member, a sixth said tubular member engaged at a distal end of said second elbow member, and said base portion engaged at a distal end of said sixth tubular member.

12. The boxing ring simulator of claim 11, further comprising a plurality of quick-release pins, wherein each said engagement is releasably secured with at least one said quick-release pin.

13. The boxing ring simulator of claim 1, wherein said base portion further comprises a flange mount and a generally flat base member.

14. The boxing ring simulator of claim 1, wherein said flexion element is selected from the group consisting of a coil spring, bungee, flexible rubber, robotic arm, hydraulic motorized connection, pneumatics, pendulum mechanical link, linear sliding element with recoil spring, compression spring, extension spring, die spring, torsion spring, tapered spring, disc spring, urethane, and an H-clip.

15. The boxing ring simulator of claim 1, further comprising a means for positionally fixing each said base portion of said plurality of posts, wherein said means for positionally fixing is selected from the group consisting of an integral weight, a removable weight, a fastener, suction, adhesive, and hook and loop fastener.

16. The boxing ring simulator of claim 1, further comprising a rubber mat.

17. The boxing ring simulator of claim 1, wherein said plurality of tiers defines a perimeter, wherein said perimeter is polygon shaped.

* * * * *